United States Patent [19]

Ramey

[11] 4,393,527

[45] Jul. 19, 1983

[54] METHOD OF CONTROLLING NON-SOLAR SWIMMING POOL HEATER

[75] Inventor: Robert M. Ramey, No. Hollywood, Calif.

[73] Assignee: Teledyne Industries, Inc., Los Angeles, Calif.

[21] Appl. No.: 418,536

[22] Filed: Sep. 15, 1982

Related U.S. Application Data

[62] Division of Ser. No. 220,377, Dec. 29, 1980, Pat. No. 4,368,549.

[51] Int. Cl.[3] ..... E04H 3/16; E04H 3/18

[52] U.S. Cl. ..... 4/493; 4/498; 4/661; 126/415; 126/416; 126/419

[58] Field of Search ..... 4/661, 493, 488, 498; 126/419, 416, 415

[56] References Cited

U.S. PATENT DOCUMENTS 3,906,928 9/1975 Wright ..... 126/416
3,970,069 7/1976 Pickett ..... 126/415
3,991,742 11/1976 Garber ..... 126/416 X
4,061,132 12/1977 Ashton et al. ..... 126/419
4,313,428 2/1982 Goldenberg ..... 126/416 X

*Primary Examiner*—Henry K. Artis
*Attorney, Agent, or Firm*—Reagin & King

[57] ABSTRACT

A swimming pool heater temperature control system is disclosed. The control system is designed to optimize the use of a conventional heater as a supplemental heat source for a solar heated swimming pool. The temperature control system operates by automatically adjusting the temperature settings of the heater to conform to the temperature vs. time profile of an optimum solar collector heating system. An embodiment is disclosed which employs two thermostats in conjunction with a time clock actuated switch to control the heater temperature profile as a function of time. Other embodiments are also described which employ a plurality of thermostats in conjunction with time clock actuated switches to provide a heater temperature profile which more closely matches that of an optimum solar collector heating system.

1 Claim, 8 Drawing Figures

METHOD OF CONTROLLING NON-SOLAR SWIMMING POOL HEATER

This application is a division of application Ser. No. 220,377, filed Dec. 29, 1980 and now U.S. Pat. No. 4,368,549.

BACKGROUND OF THE INVENTION

This invention relates to heater temperature control systems, and more particularly, to swimming pool gas, oil or electric heater temperature control systems where the heater is used as a supplemental heat source for a solar heated swimming pool.

Many prior art systems have been developed to control the temperature of conventional gas, oil and electric swimming pool heaters. Basically, these systems include a thermostat which senses the temperature of the pool water and energizes the heater when the water temperature is below a preset temperature level. This temperature level is set by the user to achieve a comfortable swimming temperature in the pool.

Control systems have also been developed in the prior art to adapt the use of solar collectors for heating a swimming pool in an effort to minimize energy consumption. Typically, these systems include means for diverting pool water to the solar collectors whenever the collector temperature exceeds the pool water temperature.

A large number of swimming pool installations include both a conventional gas, oil or electric heater and a solar collector system to heat the pool water. The objective of these installations is to use the conventional heater as an alternate heat source when there is insufficient solar heat available. Unfortunately these prior art systems result in excessive use of the conventional heater, offsetting the energy saving feature of the solar collectors.

None of the prior art temperature control systems are designed to optimize the use of a conventional heater as a supplemental heat source in a solar heating system. An ideal supplemental heat source is one that adapts to the amount of solar heat available, adding heat to the solar heating system only as required, minimizing the consumption of energy while maintaining the desired pool water temperature.

Accordingly, it is an object of the present invention to provide a new and improved swimming pool heater temperature control system.

It is another object of the present invention to provide a temperature control system which uses a conventional heater as a supplemental heat source in a solar heating system.

It is still another object of the present invention to provide a temperature control system which adapts to the amount of solar heat available in a manner which maintains the desired pool water temperature while minimizing the use of the supplemental heater.

SUMMARY OF THE INVENTION

The foregoing and other objects of the invention are accomplished by a temperature control system for controlling a conventional gas, oil or electric heater in a manner which automatically adjusts the temperature settings of the heater to conform to the daily temperature vs. time profile of a solar collector heating system.

It has been found that optimum performance of a supplemental heat source in a solar heated swimming pool system is achieved when the temperature vs. time profile of the supplemental source is made substantially equal to the temperature vs. time profile of the solar collector system under optimum sun conditions.

Operation of a supplemental heat source in this fashion results in a pool water heating system which, on a daily basis, automatically maintains the water temperatures equivalent to those expected from the operation of the solar collection system, independent of variations in solar energy available that day. At the same time, this performance is achieved while expending a minimum amount of energy for the supplemental heating.

In the preferred embodiment, the desired temperature vs. time profile for the supplemental heater is achieved by providing a plurality of thermostats all of which sense the pool water temperature. Each thermostat is preset to actuate the supplemental heater at a different temperature level. By means of a time clock each of the various thermostats is used to sequentially control the supplemental heater at predetermined times of the day. Through proper settings of the thermostat temperature levels and of the time clock sequencing intervals, the desired temperature vs. time profile for the supplemental heater is achieved. The number of thermostats employed in this embodiment may be increased to further conform the supplemental heater temperature vs. time profile to that of a solar heating system.

The temperature control system of the present invention may be implemented by using many of the components of existing pool heating systems. For example, the pool filter pump time clock may be adapted to control the thermostat time sequencing.

The use of the temperature control system of the present invention to control a supplemental heat source for a solar heated swimming pool results in minimal use of the supplemental heater while maintaining the desired pool temperature under varying conditions of available solar heat. By way of example, if on any given day full solar heat is available, no supplemental heating will occur. Conversely, if no solar heat is available on that day, the supplemental heater will raise the pool water temperature to substantially the same levels that would have been achieved under the conditions of full solar heat. For those days where only intermittent solar heat is available, the supplemental heater will be energized as necessary to raise the pool water temperature to the levels corresponding to those achieved with full solar heat.

Other objects, features, and advantages of the invention will become apparent from a reading of the specification when taken in conjunction with the drawings in which like reference numerals refer to like elements in the several figures.

BRIEF DESCRIPTION OF THE DRAWINGS

FIG. 4 is a block diagram of the swimming pool heater temperature control system of the present invention;

DESCRIPTION OF THE PRIOR ART

Figure 1:
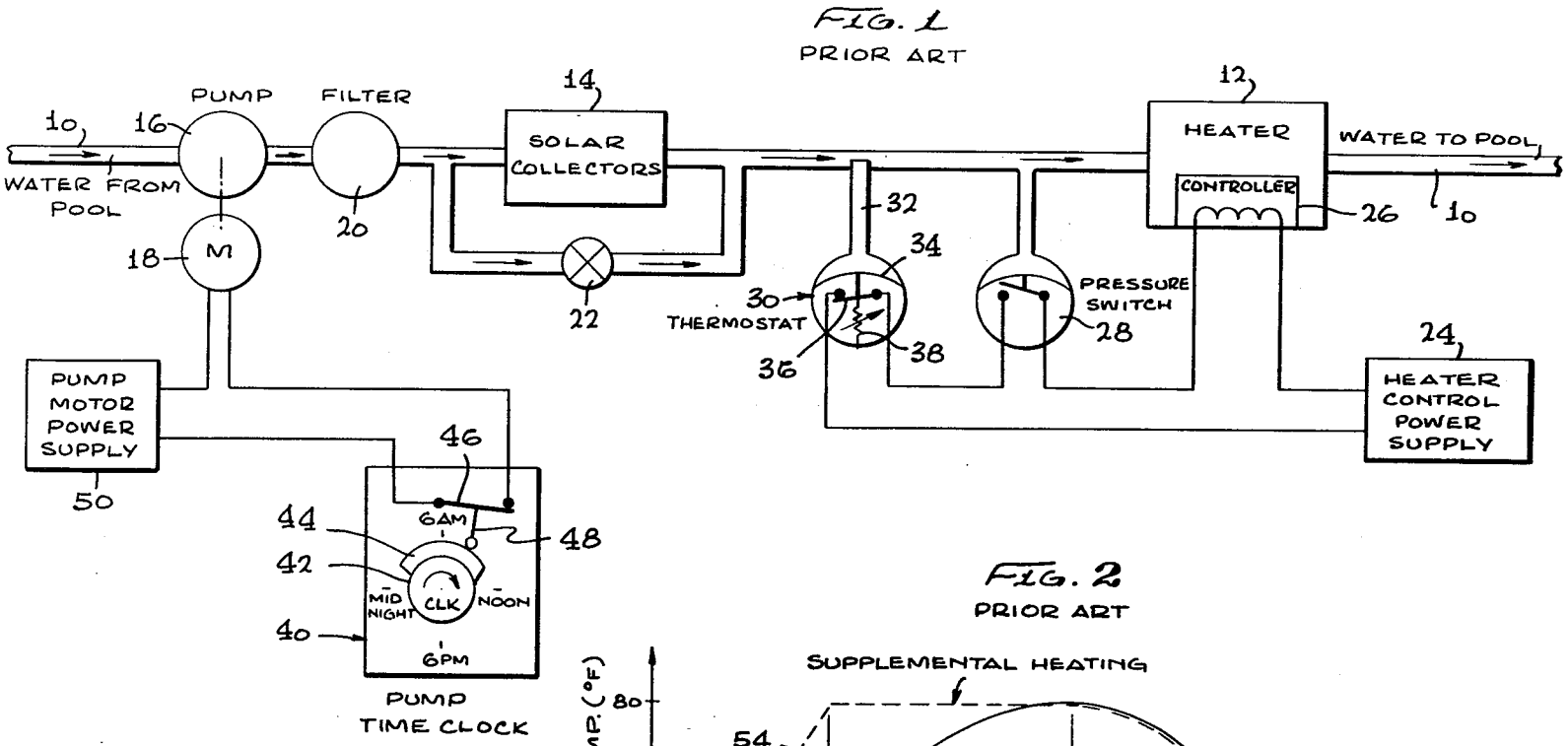
FIG. 1 PRIOR ART
FIG. 1 is a block diagram of a prior art swimming pool heater temperature control system combining both solar and supplemental heat sources.

FIG. 1 shows a prior art swimming pool temperature control system which employs both a conventional gas, oil or electric heater 12 and solar collectors 14. In the block diagram of FIG. 1 the swimming pool water 10 is shown by double solid lines with arrows indicating direction of flow. Electrical connections are shown by single solid lines. Water 10 is pumped from the pool by a pump 16 which is driven by a motor 18. The water 10 passes through a filter 20, a diverter valve 22 and the heater 12, returning to the pool. An alternate path is from filter 20 through the solar collectors 14 and the heater 12, returning to the pool. The path of the water flow is dependent upon the setting of the diverter valve 22. If diverter valve 22 is open, the pool water bypasses the solar collectors 14.

Also shown in FIG. 1 is the heater electrical control system consisting of a heater control power supply 24 connected in series with a heater controller 26, a pressure switch 28 and a switch 36 operated by a thermostat 30. The heater controller 26 may be an electrical contactor in the case of an electrically controlled heater 12 or maybe a fuel valve in the case of a gas or oil powered heater 12. When the electrical circuit is completed between the heater control power supply 24 and the controller 26, the heater is energized and begins heating the swimming pool water 10. Energizing the heater controller 26 thus requires that the pressure switch 28 and the thermostat switch 36 both be closed. The pressure switch 28 is used to sense the water pressure entering the heater 12. This pressure switch 28 is closed whenever the filter pump 16 is energized. Accordingly, the heater 12 can only by activated when the filter pump 16 is on. This configuration prevents energizing the heater 12 without water flow which would cause excessive overheating and damage to the heater 12.

The thermostat 30 is used to sense the pool water temperature. It typically consists of a fluid filled capillary tube 32, a diaphragm 34, a normally closed switch 36, and an adjustable spring 38. As the temperature of the pool water 10 increases, the fluid in the capillary tube 32 expands exerting pressure on the diaphragm 34 causing the switch 36 to open, deenergizing the heater 12. The temperature at which the switch 36 opens is a function of the setting of the spring 38. The adjustment of the spring 38 is made by the swimming pool user by rotating a calibrated temperature control knob to a desired water temperature setting.

In summary, the heater 12 will remain energized until the pool water temperature reaches the preset level of thermostat 30 at which point the heater will cycle on and off and maintain the pool water 10 at the desired preset temperature level.

When it is desired to use the solar collectors 14 to heat the swimming pool water 10, the diverter valve 22 is closed diverting the major portion of the pool water flow through the solar collectors 14, bypassing the heater 12. If the solar collectors 14 raise the water temperature above the setting of the thermostat 30, the heater 12 is deenergized.

The valve 22 may be manually closed by the user on those days when he expects sufficient solar energy to heat the pool water 10 with the collectors 14. An alternate method for controlling the valve 22 in the prior art temperature control systems is to sense the difference between the temperature of the solar collectors 14 and the temperature of the pool water 10. Whenever the temperature of the solar collectors 14 exceeds the pool water temperature, the valve 22 is closed allowing the solar collectors 14 to heat the swimming pool water 10. If the solar collector 14 temperature is less than the swimming pool water temperature, the valve 22 is opened. This type of control system is used to insure that when the solar collectors 14 are cold the warm swimming pool water 10 does not circulate through the collectors 14 which would cause reradiation of pool water heat into the atmosphere, decreasing water temperature.

As shown in FIG. 1 the motor 18 used to drive the water pump 16 is energized by means of a time clock 40. The time clock 40 typically consists of a clock motor which makes one full revolution every twenty-four hours. The clock motor rotates a disk 42 to which a cam 44 is mounted. The cam 44 in turn operates a switch 46 by means of a cam follower 48. Actuating the switch 46 energizes the pump motor 18 by connecting the pump motor power supply 50 to the pump motor 18. The relative placement of the switch 46 and the cam follower 48 determines the time of day at which the pump motor 18 will be energized. The length of the cam 44 determines the number of hours that the pump motor 18 will remain energized. Typically, the pump motor 18 is turned on at 7:00 a.m. and remains on until 6:00 p.m.. This time profile allows the solar collectors 14 to collect maximum heat during the day.

To summarize the prior art swimming pool temperature control system as shown in FIG. 1, the system is energized when the time clock 40 closes the circuit to the motor 18 which drives the pump 16. The water 10 is heated by the heater 12 and, depending on the condition of the valve 22, by the solar collectors 14. The valve 22 is either operated manually by the user on a daily basis depending on solar heat available or the valve 22 is operated as a function of the difference in temperatures between the solar collector 14 and the pool water 10.

Figure 2:
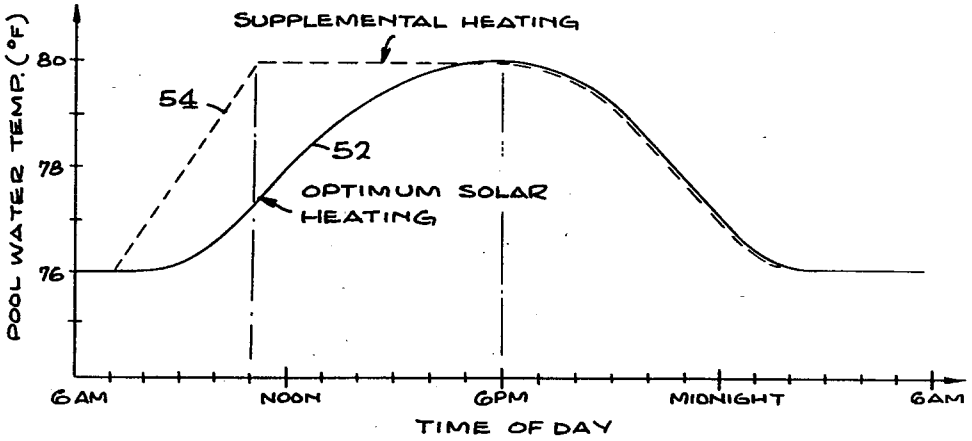
FIG. 2 PRIOR ART
FIG. 2 is a graphic illustration of the swimming pool water temperature as a function of the time of day for the prior art temperature control system of FIG. 1.

The performance of the prior art temperature control system of FIG. 1 is graphically illustrated in FIG. 2 for a variety of conditions. The solid curve 52 shown in FIG. 2 illustrates the pool water temperature profile during a twenty-four hour period when the pool water 10 is heated only by the solar collectors 14. The curve 52 in FIG. 2 assumes a solar collector installation with full sun available during the daylight hours so that the collectors 14 increase the pool water temperature to a swimming temperature of 80° F. It is also assumed that nighttime temperatures are sufficient to maintain the pool water at 76° F. Thus when the prior art control system of FIG. 1 is energized by the time clock 40 at 7:00 a.m., the solar collectors 14 begin increasing the pool water temperature from a 76° F. level to a peak of 80° F. at approximately 6:00 p.m.. At this time the pump time clock 40 turns off the system and the water temperature decreases to a minimum of 76° F. during the nighttime hours. Using the solar collectors 14 the average rate of rise of pool water temperature is approximately 0.36° F. per hour.

The dotted line in curve 54 of FIG. 2 shows the profile of pool water temperature vs. time of day when the supplemental heater 12 of the prior art system shown in FIG. 1 is used in conjunction with the solar panels 14 to heat the pool water 10. For the curve 54 it is assumed that the thermostat 30 is set at an 80° F. controlling point. Typical conventional gas, oil or electric heaters have the capability of raising the pool water temperature 1° F. per hour. Thus, as shown in curve 54, the pool water 10 is increased from the nighttime low of 76° F. within four hours. Since water heating begins when the time clock 40 energizes the system at 7:00 a.m., the pool is at the 80° F. temperature by 11:00 a.m.. The heater 12 then maintains the temperature until the system is shut down by the time clock 40 at 6:00 p.m.. At this time the pool water temperature decreases along the curve 52.

The curves 52 and 54 shown in FIG. 2 may be used to graphically illustrate the incompatability of using a conventional heater 12 as a supplementary heat source in conjunction with solar collectors 14 in the prior art control system of FIG. 1. This incompatability is a result of the steep rate of temperature rise from the heater 12 compared to the slow temperature rise from the solar collectors 14. The supplemental heater 12 remains energized until the water temperature reaches the thermostat 30 set point of 80° F. Thus in FIG. 2, even though optimum solar heat is available, the heater 12 is energized for four hours shown by the sloping portion of curve 54. Until the solar panels can maintain the water temperature at 80° F., which occurs at 6:00 p.m., the heater 12 continues to consume energy during the flat portion of the curve 54.

The result of this type of operation is that the supplemental heater 12 is being used to provide the majority of the water heating with little or no energy savings from the use of the solar collectors 14.

DESCRIPTION OF THE PREFERRED EMBODIMENT

An optimum supplemental heat source in a solar heating system is one which would not be energized at all if the solar collectors 14 of the system are providing optimum water heating. Thus no energy is expended in such a system. Conversely, if no solar heat is available, the supplemental heat source should provide water heating effectively equal to that achieved during optimum solar collection.

Figures 2, 3:
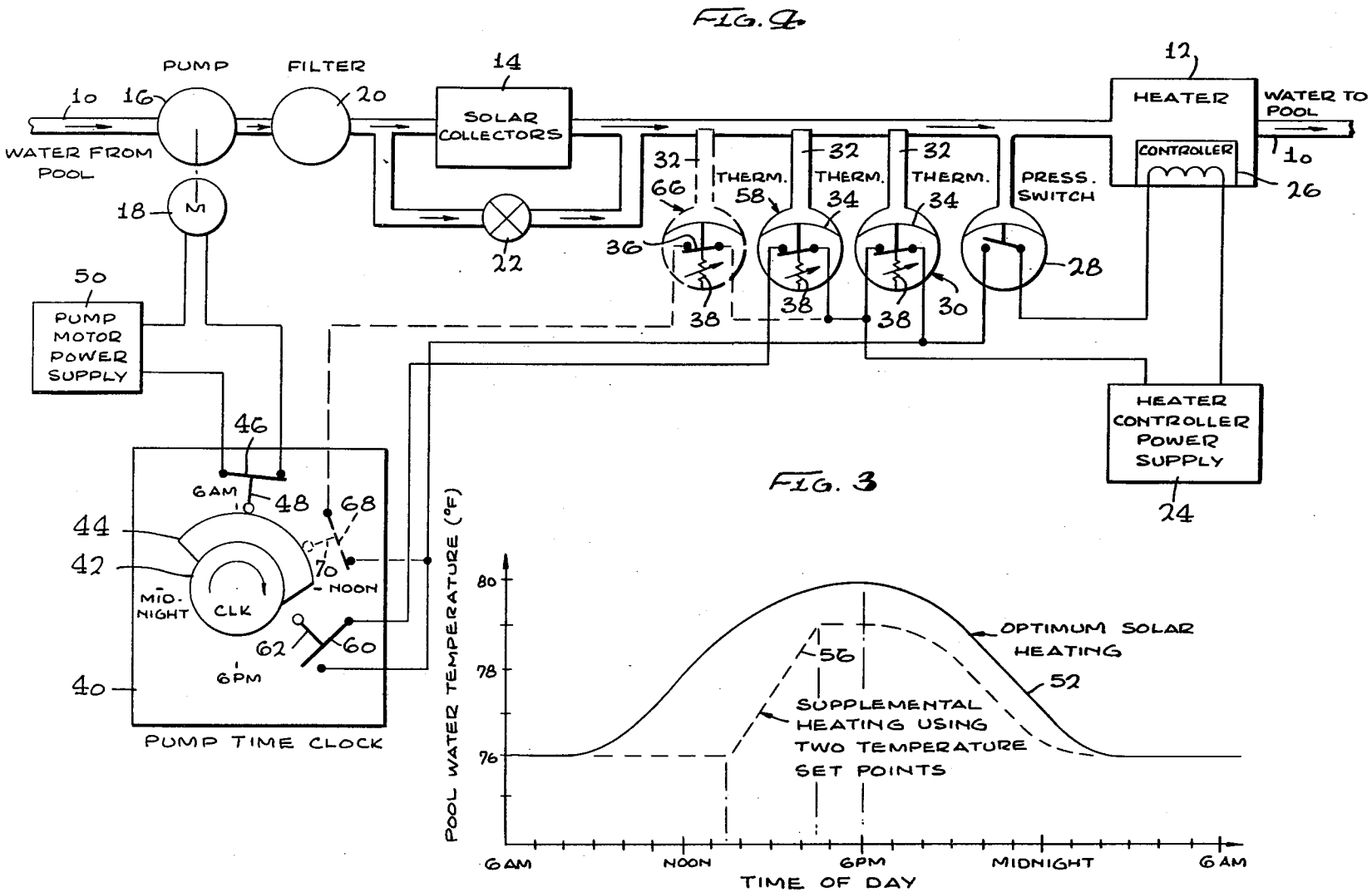
FIG. 3 is a graphic illustration of the swimming pool water temperature as a function of the time of day for an embodiment of the present invention employing two temperature set points, showing performance when optimum solar heat is available and when no solar heat is available.

It has been found that this criterion for optimum supplemental heating is met if the temperature vs. time curve of the heater 12 is made to conform to the temperature vs. time curve for the solar collectors 14 during optimum solar collection. Additionally, the temperature vs. time curve for the heater 12 must remain beneath the temperature vs. time curve for the solar collectors 14. This condition is shown by curves 52 and 56 in FIG. 3. Curve 52 represents optimum solar collection by the solar collectors 14. This is the same curve described earlier in FIG. 2. Also shown in FIG. 3 is a curve 56 which represents a temperature vs. time profile for supplemental heater 12 in the preferred embodiment. Note that the curve 56 lies within the envelope of the curve 52. This is as opposed to the curve 54 in FIG. 2 which lies above and outside the envelope of the curve 52. By maintaining the heater 12 temperature profile within the envelope of the optimum solar heating curve 52, heater 12 will remain deenergized as long as the solar collectors 14 are delivering their projected optimum heat output. Additionally, the curve 56 is shaped to follow the envelope of the curve 52 so that in the absence of solar heat the heater 12 will provide a temperature profile (curve 56) which closely simulates that which would have been achieved if optimum solar collection occurred during that day. The temperature control system of the present invention as shown in FIG. 4 achieves the temperature curve 56 for the heater 12 in the following manner.

Referring to FIG. 4 there is shown a block diagram of the swimming pool heater temperature control system of the present invention. As in the prior art system shown in FIG. 1, the pool water 10 is pumped from the pool by the pump 16 and passed through the filter 20, the solar collectors 14 and the heater 12 before returning to the pool. The portion of the heater control circuit shown in FIG. 4 comprising the heater controller 26, the heater controller power supply 24, the pressure switch 28 and the thermostat 30 is identical in operation to the heater control circuit described in the prior art system of FIG. 1. The motor 18 which operates the pump 16 is controlled by time clock 40 as in the prior art system by operating a switch 46 to close the circuit to the pump motor power supply 50.

Also shown in FIG. 4 is a second thermostat 58 which is used to sense the temperature of the water 10 in a manner analogous to the first thermostat 30. The thermostat 58 may be set by means of the adjustable spring 38 to a desired water temperature independent of the setting of the thermostat 30. As described above, the thermostat 30 controls the heater 12 by opening and closing the circuits to the heater controller 26. The thermostat 58 is electrically connected in parallel with the thermostat 30 through the cam operated switch 60 mounted within the time clock 40. The cam operated switch 60 is, in turn, actuated by the cam 44 through the cam follower 62. The placement of the cam follower 62 around the periphery of the clock dial 42 determines the time of day at which the cam 44 will actuate the switch 60.

As indicated above, the thermostats 30 and 58 contain normally closed switches 36 which are moved to their open positions when the water temperature reaches the settings of the thermostats. Thus, when two thermostats 30 and 58 are wired in parallel, the heater 12 is controlled by the thermostat which has the highest temperature setting.

The system described thus far may be used to generate the curve 56 in FIG. 3 by setting the temperature level of thermostat 30 to 76° F. and by setting the temperature level of thermostat 58 to 79° F. Cam follower 62 is then placed at a point around the clock dial 42 whereby switch 60 is actuated at 1:30 p.m..

The sequence of operation of the control system described thus far begins at 7:00 a.m.. At this time the time clock 40 actuates the switch 46 causing the pump 16 to pressurize the water system. Pressure switch 28 closes and the heater 12 is now controlled by thermostat 30 which has been set to 76° F. This condition corresponds to the horizontal portion of the curve 56 in FIG. 3 between 7:00 a.m. and 1:30 p.m.. The heater 12 will maintain the 76° F. water temperature until 1:30 p.m. when the cam 44 of the time clock 40 actuates switch 60 placing the thermostat 58 electrically in parallel with the thermostat 30. The heater 12 is now controlled by the thermostat 58 and thus begins heating the water 10 to the temperature setting of thermostat 58 which is 79° F. This condition corresponds to the ramp portion of the curve 56 beginning at 1:30 p.m.. When the water temperature reaches the desired 79° F., the heater 12 maintains this temperature level until the time clock 40 deenergizes the pump motor 18 at 6:00 p.m..

Thus by providing the second thermostat 58 and the cam operated switch 60, the temperature profile of the heater 12 may be shaped as a function of time. The profile may also be made to lie within the envelope of the of the optimum solar heating curve 52 as shown in FIG. 3. The temperature settings of the thermostats 30 and 58 and the time settings for actuating the switch 60 may be chosen to create a variety of shapes for the temperature profile 56 of the heater 12.

However, to meet the criteria that the supplemental heater 12 be deenergized when the solar collectors 14 are providing optimum heating, the temperature setting of the thermostat 58 must be coordinated to the time setting of the switch 60. In general, the temperature setting of the thermostat 58 at the time of closure of the switch 60 must be below the temperature shown by the optimum solar heating curve 52 at that same time of day.

Referring to FIG. 3 it can be seen that at 1:30 p.m. the temperature profile 52 for the solar collectors 14 is at a level of 79° F. Thus, when switch 60 closes at 1:30 p.m., the thermostat 58 (set at 78° F.) is open and the heater 12 is not energized, since the pool water 10 has already been heated by the solar collectors 14 to 79° F. As a further example, a temperature setting of 78° F. and a time of noon represent an alternate set of values for temperature and time which meet the above criteria.

From the foregoing discussion it can be seen that if the optimum temperature curve 52 is achieved by the solar collectors 14, the heater 12 is never energized. Conversely, if no solar energy is available, the heater 12 will supply all of the energy to heat the water 10 according to the temperature curve 56. This will increase the temperature of the pool water 10 to a comfortable swimming temperature of 79° F. at approximately 4:30 p.m..

Figure 5:
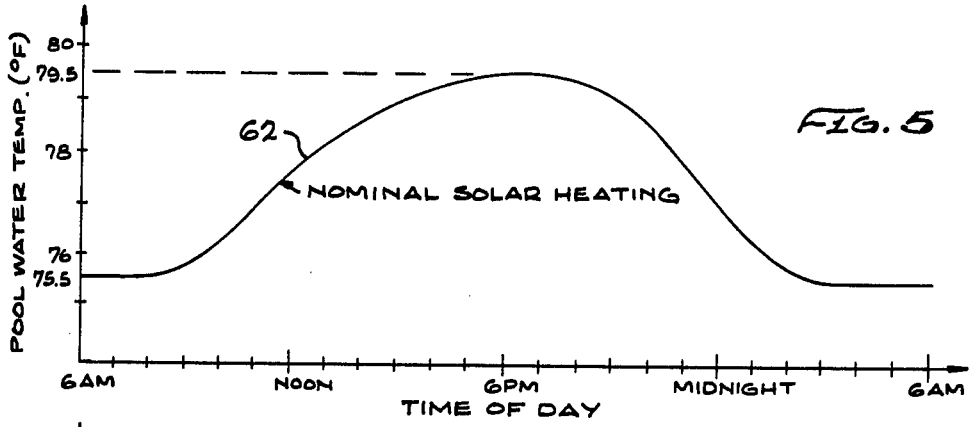
FIG. 5 is a graphic example of swimming pool water temperature as a function of the time of day when nominal solar heat is available and no supplemental heat is provided.

To illustrate the operation of the temperature control system described thus far for solar heating profiles that are less than optimum, consider the example shown in curve 62 of FIG. 5. Curve 62 in FIG. 5 represents a nominal solar temperature profile which might occur on an overcast day in combination with cooler evening temperatures. Thus in curve 62 the maximum water temperature achieved is 79.5° F. as opposed to 80° F. for the optimum curve 52. In addition, the cooler evenings result in a 75.5° F. overnight temperature. Curve 62 represents the water temperature profile when heater 12 is not being used for supplemental heat.

Figure 6:
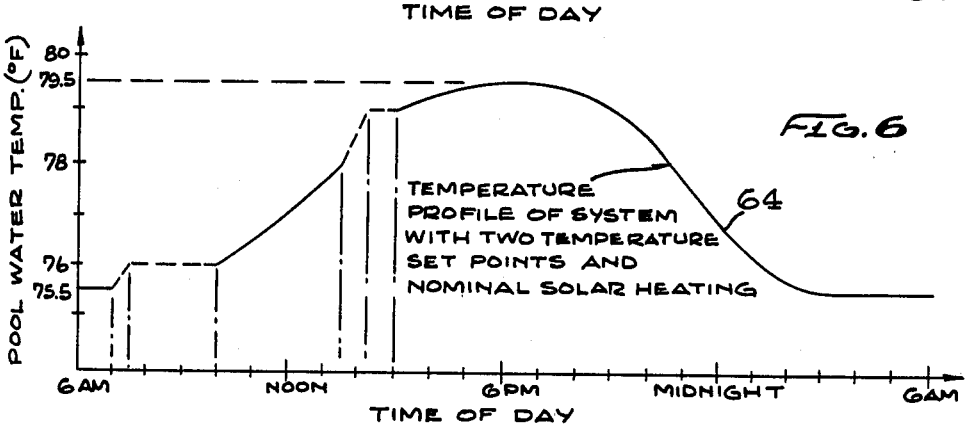
FIG. 6 is a graphic illustration of the swimming pool water temperature as a function of the time of day when nominal solar heat is available and supplemental heat is provided by the embodiment of the present invention employing two temperature set points.

Curve 64 in FIG. 6 shows the temperature vs. time profile of the temperature control system thus described with the heater 12 used to supplement the nominal solar temperature profile of curve 62 in FIG. 5. The curve 64 is the result of combining the temprature curve 56 of heater 12 with the nominal solar temperature profile 62. The dotted portions of curve 64 represent the operation of heater 12 and the solid portions represent the heating provided by the solar collectors 14.

Beginning at 7:00 a.m. the heater 12 is actuated and is controlled by thermostat 30 to increase the pool water temperature to 76° at approximately 7:30 a.m.. The pool water is maintained at 76° F. by the heater 12 until the heating effect of the solar collectors 14 begins to further increase the water temperature at approximately 10:00 a.m.. The water temperature profile continues along the curve dictated by the solar collectors 14 until 1:30 p.m.. At this time thermostat 58 takes over control of heater 12, increasing the pool water temperature to the 79° F. set point of the thermostat 58. This temperature level is maintained by the heater 12 until the solar collectors 14 further increase the water temperature at approximately 3:00 p.m.. At this time the supplemental heater 12 is deenergized and the curve 64 follows the solar collector 14 profile for the remainder of the day.

From FIG. 6 it can be seen that the heater 12 acts as a supplemental heat source which adds heat to the pool water only as required to maintain comfortable pool water temperatures. The fact that the heater 12 is only energized for short periods of time during the day minimizes energy consumption by the heater 12 and yet results in adequate pool water heating. Supplemental heating by heater 12 is performed on a fully automatic basis by the temperature control system of the present invention.

As described above, the optimum temperature profile for the heater 12 is one which closely matches the optimum solar temperature profile 52. The embodiment of the control system of the present invention thus described achieves temperature profile matching by providing two temperature set points as set by thermostats 30 and 58. Closer matching of the temperature profile of the heater 12 to that of the solar collectors 14 may be achieved by adding additional temperature set points as described below.

Referring again to FIG. 4 there is shown in dotted lines a third thermostat 66 which is electrically wired in parallel with thermostats 30 and 58 through a cam actuated switch 68. In a manner analogous to the operation of the thermostat 58, the thermostat 66 can be set at still a third temperature setting. The thermostat 66 will control the heater 12 at a time which is a function of the placement of the cam follower 70 around the periphery of the clock dial 42 of the time clock 40.

Figure 7:
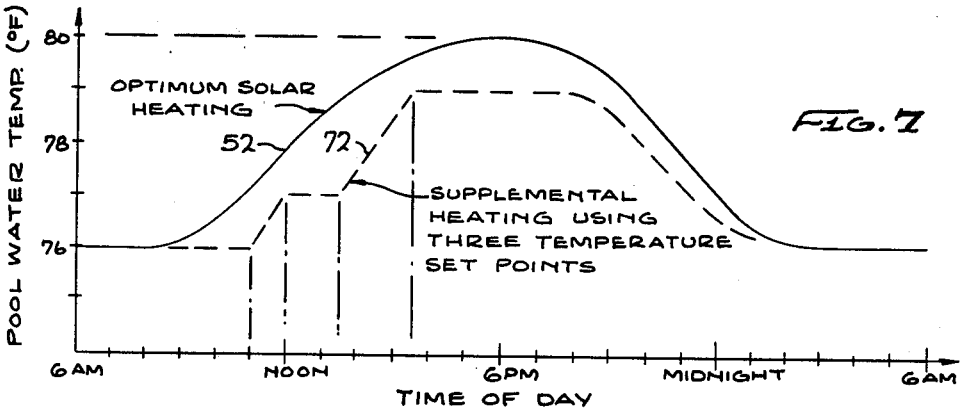
FIG. 7 is a graphic illustration of the swimming pool water temperature as a function of the time of day for an embodiment of the present invention employing three temperature set points showing performance when optimum solar heat is available and when no solar heat is available.

Setting the thermostat 66 to a temperature level of 77° F. and placing switch 68 so that it closes at 11:00 a.m. results in the heater 12 temperature profile of curve 72 shown in FIG. 7. Curve 72 in FIG. 7 clearly illustrates that by the addition of thermostat 66, the heater 12 temperature profile can be made to more closely simulate the optimum solar temperature profile 52. In a similar fashion additional thermostats and cam actuated switches may be added to the control system of FIG. 4 to cause the curve 72 of FIG. 7 to more closely approach the curve 52. Thus the slope of the curve 52 can be approximated by a plurality of small temperature and time steps over the interval from 7:00 a.m. to 6:00 p.m..

The operation of the temperature control system of the present invention with the addition of thermostat 66 and cam actuated switch 68 may be illustrated by using the nominal solar profile of curve 62 shown previously in FIG. 5. The temperature profile that results when heater 12 is used as a supplemental heat source in the three thermostat system is shown as curve 74 in FIG. 8. The curve 74 may be analyzed in a manner similar to the above discussion of the two thermostat version of the system. Dotted lines represent operation of the heater 12, and solid lines represent solar heating by the collectors 14.

Beginning at 7:00 a.m. the heater 12 increases the pool water temperature to the 76° F. setting of thermostat 30 in approximately one-half hour. This temperature level is maintained until solar heat further increases pool temperature at 10:30 a.m., at which time the heater 12 is deenergized. At approximately 11:00 a.m. the thermostat 66 controls heater 12, increasing pool water temperature to 77° F. At noon the solar collectors 14 resume the heating function, deenergizing the heater 12. At 1:30 p.m. the thermostat 58 takes control of the heater 12 increasing the pool water temperature to 79° F. This temperature level is maintained until 3:00 p.m. when the solar collectors 14 further increase the pool water temperature to 79.5° F.

Figure 8:
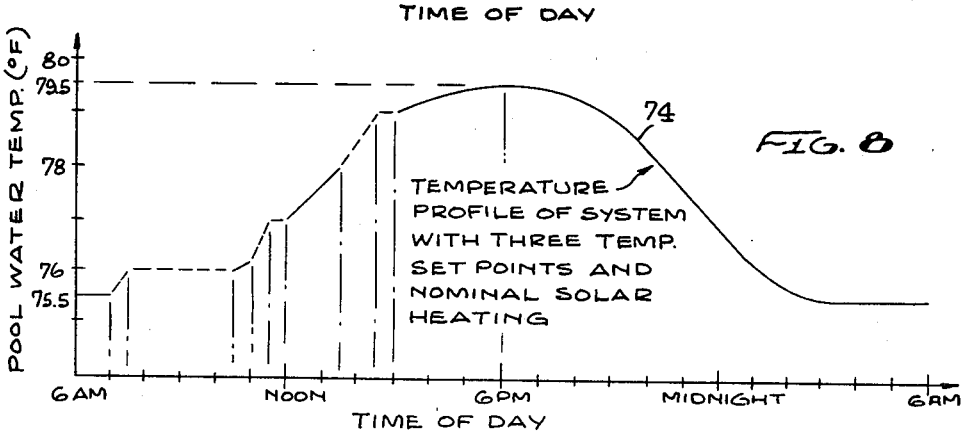
FIG. 8 is a graphic illustration of the swimming pool water temperature as a function of the time of day when nominal solar heat is available and supplemental heat is provided by the embodiment of the present invention employing three temperature set points.

A comparison of curves 64 and 74 of FIGS. 6 and 8 respectively illustrates the effect of adding the thermostat 66 and the switch 60 to the temperature control system. The addition of these components causes the supplemental heater 12 to add heat to the pool water several times during the day so that the that the pool water temperature profile 74 more closely follows the optimum solar profile of curve 52.

The operation of the swimming pool heater temperature control system of the present invention as shown in FIG. 4 is based on the proper temperature settings of the thermostats 58 and 66 and of the time settings of the switches 60 and 68 in an effort to match an optimum solar temperature profile such as shown by curve 52. Since the optimum solar temperature profile for any given pool installation varies during the seasons of the year, it is to be expected that the thermostat settings and cam actuated switch time settings will be modified from time to time during the year in accordance with the anticipated solar heat available during that particular season.

As described above the valve 22 shown in FIG. 4 may be used to bypass the collectors 14. As in the prior art system, the valve 22 may either be operated manually or automatically as a function of the difference in temperatures between the solar collectors 14 and the pool water 10. Thus in the configuration of FIG. 4, the valve 22 is opened if the temperature of the pool water 10 exceeds the temperature of the collectors 14, avoiding reradiation of heat from the pool water into the atmosphere. Controlling the valve 22 in this fashion in the control system of the present invention does not interfere with the use of the heater 12 as a supplemental heat source.

While the invention is disclosed and a particular embodiment thereof is described in detail, it is not intended that the invention be limited solely to this embodiment. Many modifications will occur to those skilled in the art which are within the spirit and scope of the invention. For example, multiple thermostat settings may be implemented by electronic means such as by using a single thermistor temperature sensor in combination with a plurality of electronically set temperature levels. Similarly, multiple time settings may be achieved by electronic means such as a digital clock. It is thus intended that the invention be limited in scope only by the appended claims.

What is claimed is:

1. A method fo controlling a non-solar heater to provide supplemental heating for a solar-collector heated swimming pool, comprising the steps of:

providing solar collectors;

connecting the solar collectors to heat the water in the swimming pool, whereby the collectors establish an optimum daily water temperature vs. time profile when full solar energy is available;

connecting the non-solar heater to heat the water in the swimming pool;

providing a non-solar heater temperature vs. time profile which closely approximates the optimum profile; and controlling the non-solar heater to heat the pool water in accordance with the non-solar heater temperature vs. time profile, whereby the non-solar heater acts to supplement the solar collectors to that the water temperature closely approximates the optimum temperature profile when full solar energy is not available.

* * * * *